US005900850A

United States Patent [19]

Bailey et al.

[11] Patent Number: 5,900,850

[45] Date of Patent: May 4, 1999

[54] PORTABLE LARGE SCALE IMAGE DISPLAY SYSTEM

[76] Inventors: James Tam Bailey, 1613 Pleasant Run, Carrollton, Tex. 75006; Phillip L. Scheldt, 6319 Turner Way, Dallas, Tex. 75230

[21] Appl. No.: 08/704,021

[22] Filed: Aug. 28, 1996

[51] Int. Cl.[6] ..... G09G 3/34

[52] U.S. Cl. ..... 345/55; 40/605; 40/606; 40/610; 340/815.83; 361/681; 345/31; 345/46

[58] Field of Search ..... 345/31, 46, 55, 345/56, 57, 82, 83; 40/427, 437, 438, 446, 605, 606, 610; 340/815.4, 815.45, 815.81, 815.82, 815.83, 815.92; 361/681

[56] References Cited

U.S. PATENT DOCUMENTS

| | | | |
|---|---|---|---|
| 4,612,720 | 9/1986 | Manners-Smith et al. | 40/211 |
| 4,782,336 | 11/1988 | Bailey | 345/55 |
| 4,833,542 | 5/1989 | Hara et al. | 348/383 |
| 5,410,328 | 4/1995 | Yoksza et al. | 345/82 |
| 5,428,365 | 6/1995 | Harris et al. | 345/55 |
| 5,532,711 | 7/1996 | Harris | 345/55 |

*Primary Examiner*—Mark K. Zimmerman
*Assistant Examiner*—Vincent E. Kovalick
*Attorney, Agent, or Firm*—Akin, Gump, Strauss, Hauer & Feld, L.L.P.

[57] ABSTRACT

A large scale, portable light emitting diode image display system including one or more display panels comprising a web or netlike structure, preferably formed of interconnected flexible foldable strap members arranged in plural vertical columns and horizontal rows. Light emitting diode light sources are mounted on the column straps at predetermined spaced apart points to form a matrix for projecting multi-color images. Each panel includes fasteners at opposite ends of horizontal straps for connecting the panels to each other and each panel includes connectors at opposite ends of the vertical straps for connecting the panels to each other and to a support structure for erecting the display system as a stage backdrop, billboard or other image display arrangement. Each panel may include one or more power supply units and control circuits mounted in enclosures supported by the panels and connected to a master control unit for controlling the light sources to project multicolored stationary or animated images, video images or alphanumeric text images.

18 Claims, 6 Drawing Sheets

PORTABLE LARGE SCALE IMAGE DISPLAY SYSTEM

FIELD OF THE INVENTION

The present invention pertains to a portable, foldable, light weight image display system comprising plural flexible weblike panels supporting rows and columns of discrete light sources, such as an array of light emitting diodes (LEDs), particularly adapted for image and information displays.

BACKGROUND

Large scale image display systems have become increasingly popular for use in connection with indoor and outdoor stage performances, as image and information displays in various entertainment venues and as information displays for viewing by large audiences in stadiums, theaters or other public gathering places.

Heretofore, large scale image display systems have been characterized by large, rigid structural panels which are assembled and supported by complex support structure on or adjacent to performance stages in both indoor and outdoor arenas. One type of large scale image display system actually utilizes a large array of relatively small cathode ray tube (CRT) image projection elements arranged in rows and columns and supported by complicated, heavy structure. Prior art display systems are not only heavy and complex but the requirements for transporting these displays from one location to another for use by touring entertainment groups, for example, requires complicated erection and derigging or disassembly procedures and equipment as well as several large over-the-road vehicles for transporting the display system, from one locale to the next. Moreover, the electrical power requirements for prior art display systems have been significant as well as the influence of these systems on the heating and cooling requirements for indoor arenas.

Accordingly, there has been a strongly felt need to develop an improved large scale portable image display system which is capable of being erected on, behind, or adjacent to a performance stage, on a facade in a public gathering place, such as a stadium or arena, or otherwise positioned at a location for projecting large scale animated images, including video images and/or information to audiences which are usually located substantial distances from the display system itself. Certainly, a reduction in weight and size of the system, when disassembled for transport or storage, is welcome. Moreover, it has also been deemed desirable to provide image display systems which have reduced power requirements while possessing the ability to project multicolored images with good image resolution. These desiderata have been strongly felt in the entertainment industry. It is to these ends that the present invention has been developed.

SUMMARY OF THE INVENTION

The present invention provides a portable large scale image display system, particularly adapted for use in conjunction with stage performances, athletic performances, and other public or private gatherings in both indoor and outdoor arenas. The image display system is also adapted for use in locations wherein it is desirable to provide a large image display for viewing by an audience disposed a substantial distance away from the display system itself, such as in a stadium, a large theater or other facility where entertainment or information display for a large audience is carried out.

In accordance with one important aspect of the invention, a large scale, portable, image display system is provided which is characterized by a web of generally flexible strap-like members, not unlike a net, on which is mounted a matrix (rows and columns) of light sources which are controllable to project single or multicolored animated, still or video images as well as alphanumeric information to a viewing audience. The flexible fabric straps are suitably interconnected to each other to form a web or net-like panel structure supporting the rows and columns of light sources which are arranged spaced from each other a suitable distance so that an image of suitable resolution may be projected. The display system may be made of up a plurality of panels, each panel supporting a predetermined number of light sources thereon. The light sources are adapted for control by a suitable control system connected to the light sources by way of control circuits, selected ones of which may be supported in enclosures mounted on the panels.

The present invention further provides a large scale, portable image display system which may be easily erected or rigged and derigged for transport or storage. At least portions of the display system may be stored in part of the system rigging and support structure which may advantageously be used as a carrying or storage container. The web or netlike support structure for the light sources is lightweight, easily stored in a folded or rolled condition and provides minimal wind resistance when erected in various outdoor settings.

Still further in accordance with the invention, a portable large scale image display system is provided which is characterized by a matrix of light emitting diodes (LEDs) which are adapted for projecting multicolor images. The LEDs are preferably clustered in groups of LEDs supported on housings or modules which are mounted on the weblike support structure in a manner which provides for easy removal and replacement of the clustered light sources, individually. Each cluster or module of LEDs is electrically connected to a control circuit disposed in an enclosure mounted on the flexible weblike support and conductor elements between the light sources and the control circuits are routed along the rows and columns of strap members making up the web.

Those skilled in the art will further appreciate the advantages and features of the invention mentioned above together with other important aspects thereof upon reading the detailed description which follows in conjunction with the drawing.

DESCRIPTION OF A PREFERRED EMBODIMENT

Figure 1:
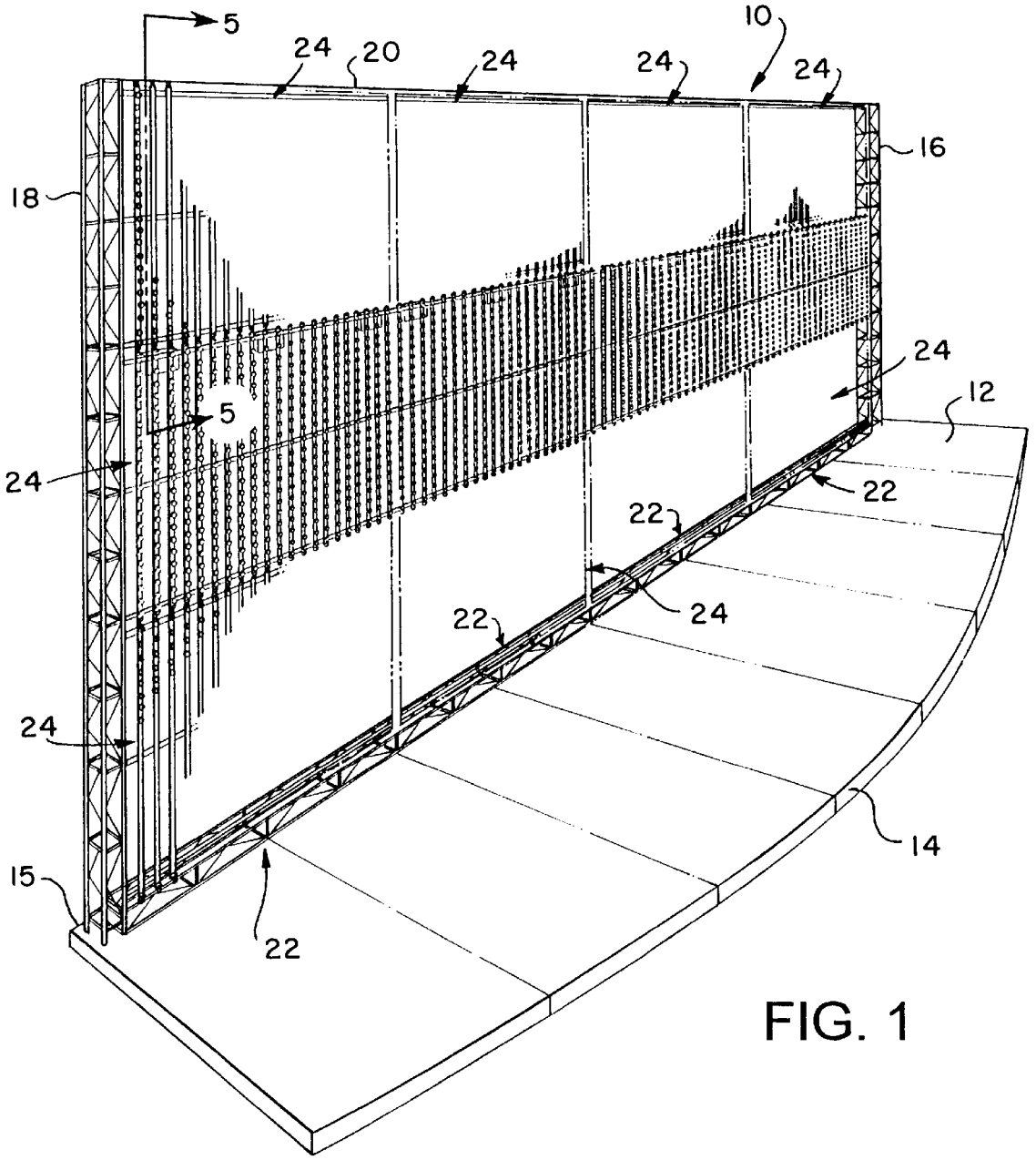
FIG. 1 is a perspective view of a large scale portable image display system in accordance with the present invention.

In the description which follows like elements are marked throughout the specification and drawing with the same reference numerals, respectively. The drawing figures are not necessarily to scale and certain elements may be shown in generalized or schematic form in the interest of clarity and conciseness.

Referring to FIG. 1, there is illustrated a portable image display system in accordance with the invention and generally designated by the numeral 10. The display system 10 is shown erected at the rear of a performance stage 12 wherein various forms of entertainment may be carried out for an audience, not shown, seated or standing beyond the front edge 14 of the stage 12 and facing the display 10. The display system 10 may be interposed between spaced apart upstanding tower or column members 16 and 18 which may be of a conventional truss type construction and suitably guyed or otherwise supported adjacent to the rear edge 15 of the stage 12, for example. A suitable support, such as a cable 20, may be stretched taut between the towers 16 and 18 at the upper ends thereof, respectively. Alternatively, a suitable beam may extend between and be connected to the towers 16 and 18 at their upper ends in place of the cable 20. Elongated beamlike members 22 extend end to end between the towers 16 and 18 at the respective bases of the towers and are disposed on the stage 12. The beam members 22 may be generally rectangular box truss type structures, similar to the towers 16 and 18, but having one longitudinal side of the truss being substantially devoid of transverse truss members for purposes to be described in further detail herein.

The display 10 comprises a plurality of panels, each generally designated by numeral 24, which may be interconnected. In the exemplary display shown in FIG. 1, plural panels 24 are arranged in four columns and three rows per column. However, those skilled in the art will recognize that various other combinations of the panels 24 may be connected to each other to provide other configurations of the overall display. In certain applications, the display system 10 may be made up of just one panel 24, as will also be appreciated by those skilled in the art from the following description.

Figure 2:
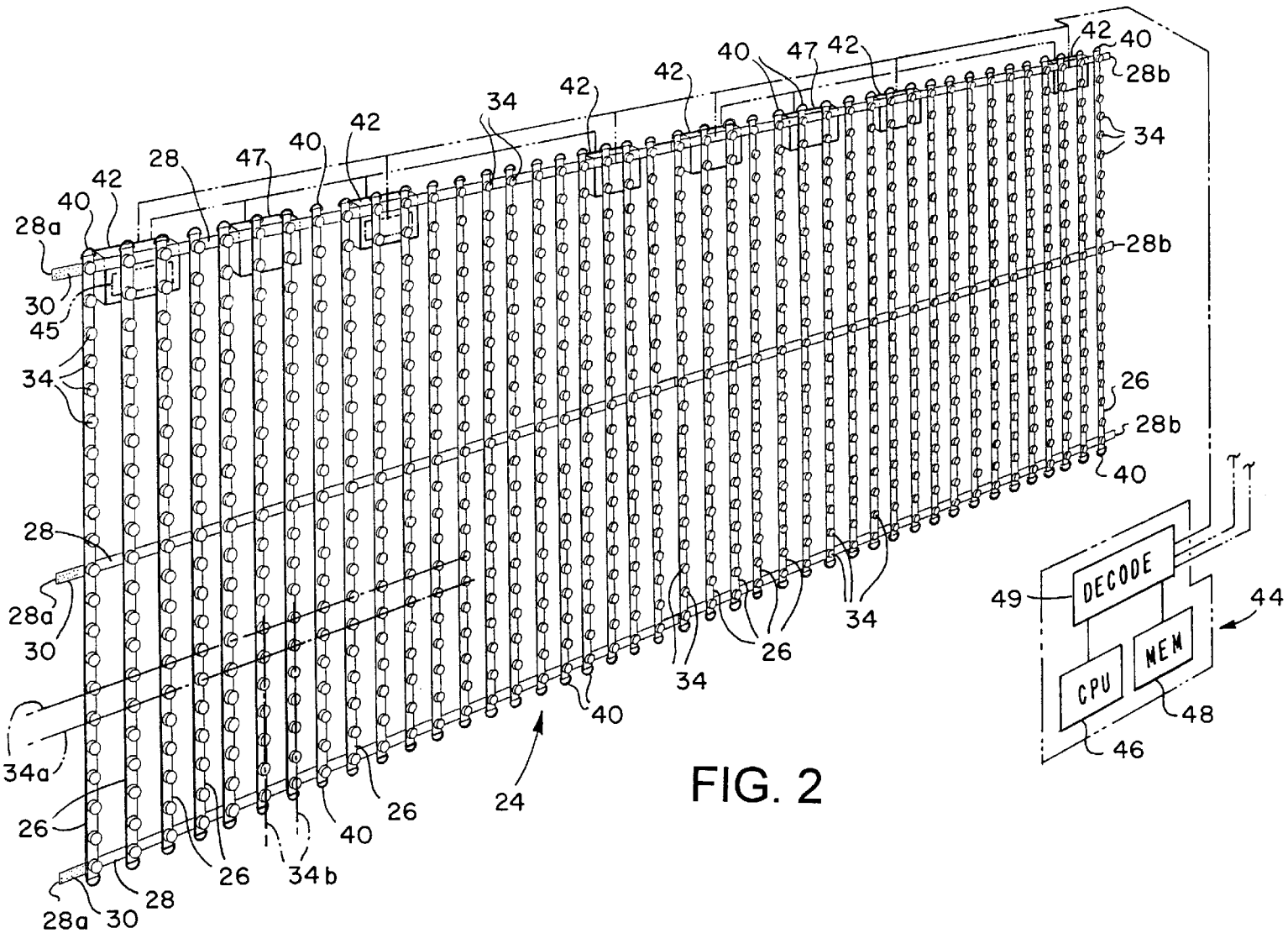
FIG. 2 is a perspective view of one panel of the display system shown in FIG. 1.

Referring now to FIG. 2, one of the panels 24 for the display system 10 is illustrated in further detail. Each of the panels 24 is characterized by plural, vertically extending, spaced apart, generally parallel, flexible support members 26 interconnected by plural spaced apart, generally horizontally extending, parallel flexible support members 28. The support members 26 and 28 form a web or netlike structure and may be formed of woven fabric straps, respectively. In particular, by way of example, each of the support members 26 may comprise flexible nylon strapping of about 1.75 inches to 2.0 inches width and having a tensile working strength of about 1,000 pounds. The horizontal support members 28 may also be woven nylon strapping of 1.75 inches width and having a working strength of 1,500 pounds. The support members 28 are preferably of slightly greater thickness or strength rating to give added stiffness thereto so as to facilitate maintaining the panel 24 as a generally planar member when it is supported alone or in the display system 10. The dimensions and spacing of the strap members may be varied in accordance with panel size, image resolution and materials used for the weblike panel structure. Opposite ends 28*a* and 28*b* of support members 28 are provided with suitable fastening means, such as strips of hook fastener 30 and loop fastener 32, see FIGS. 2, 3A and 7. The fastening strips 30 and 32 are applied to opposite sides of the straps 28 so that adjacent panels 24 may be secured to each other at the fastening strips 30 and 32, respectively.

Referring further to FIG. 2, each of the flexible support members 26 is adapted to support a plurality of spaced apart light sources 34 and such that these light sources are arranged in plural columns. The spacing of the light sources 34 along each of the members 26 is such that a matrix of vertical columns 34*a* and horizontal rows 34*b* of light sources is provided, as indicated in FIG. 2. In this way a large, multi-point light source array may be provided wherein each of the light sources may be energized selectively to generate various stationary or animated images, various video images and alphanumeric text. One preferred spacing of the support members 26 and the light sources 34 is on about 6.0 inch centers for a panel 24 having a horizontal length of about twenty feet and a height of about ten feet. Although only three spaced apart horizontal support members 28 are shown in FIG. 2, additional horizontal support members may be used, if necessary. Moreover, for a large scale image display system the vertical spacing of the light sources 34 may also be approximately 6.0 inches. The viewing distance from the display 10 and the image resolution desired may dictate other spacings. The support members 26 and 28 may be suitably interconnected at their contiguous surfaces by conventional means such as stitching 36, for example, see FIG. 5. Each of the support members 26 preferably includes. suitable fastening means disposed at its opposite ends. By way of example, as shown in the drawing figures, each support member 26 is provided with a somewhat D-shaped connector ring 40 suitably attached to each end thereof.

As further shown in FIG. 2, each panel 24 may also be provided with spaced apart weathertight enclosures 42 suitably supported thereon and adapted to enclose certain control elements for energizing and de-energizing the light sources 34 by a suitable control system 44. In particular, if the light sources 34 are clusters of light emitting diodes, in accordance with the preferred embodiment of the invention to be described in further detail herein, the control system 44 may include a suitable electronic digital computer or central processing unit (CPU) 46, a suitable memory circuit 48, a decoder and input/output control circuit 50 and suitable driver circuits 45 disposed in the enclosures 42. Control system 44 is operable for energizing selected ones of the light sources 34 in the respective rows and columns 34*a* and 34*b* indicated in FIG. 2, to provide an alphanumeric display, stationary or animated graphics displays of selected designs or video images. The control system 44, if adapted for energizing an array or matrix of light emitting diodes, may be of a type commercially available and is believed to be within the purview of one of ordinary skill in the art of image display systems utilizing light emitting diodes as well as other light sources for providing large scale animated image display systems and the like.

Each of the panels 24 is provided with a suitable number of enclosures 42 for the appropriate control circuits for the respective light sources 34. For example, the driver control circuits 45 disposed in the enclosures 42 may comprise suitable switches for energizing and deenergizing the light sources 34 at particular locations in the respective rows 34*a* and columns 34*b* so that a suitable image is displayed by each panel 24 in concert with the adjacent panels to provide a coherent image by the display system 10.

Referring further to FIG. 2, each panel 24 is also preferably adapted to support enclosures 47, two shown by way of example, which enclosures include suitable circuitry for providing DC electrical power to the circuits 45 disposed in the enclosures 42. The enclosures 47 may be suitably connected to a source of AC electrical power, for example, and are operable to provide DC electrical power to each of the enclosures 42 whereby the circuitry 45 in the enclosures 42 is then operable to control energization and de-energization of the respective light sources 34. Although the enclosures 42 and 47 are shown mounted on the panels 24 across an upper edge strap member 28, these enclosures may also be mounted along the lower edge of each panel so that the weights of the enclosures will aid in supporting the panels to be suspended in a generally planar configuration.

Figures 3A, 3B:
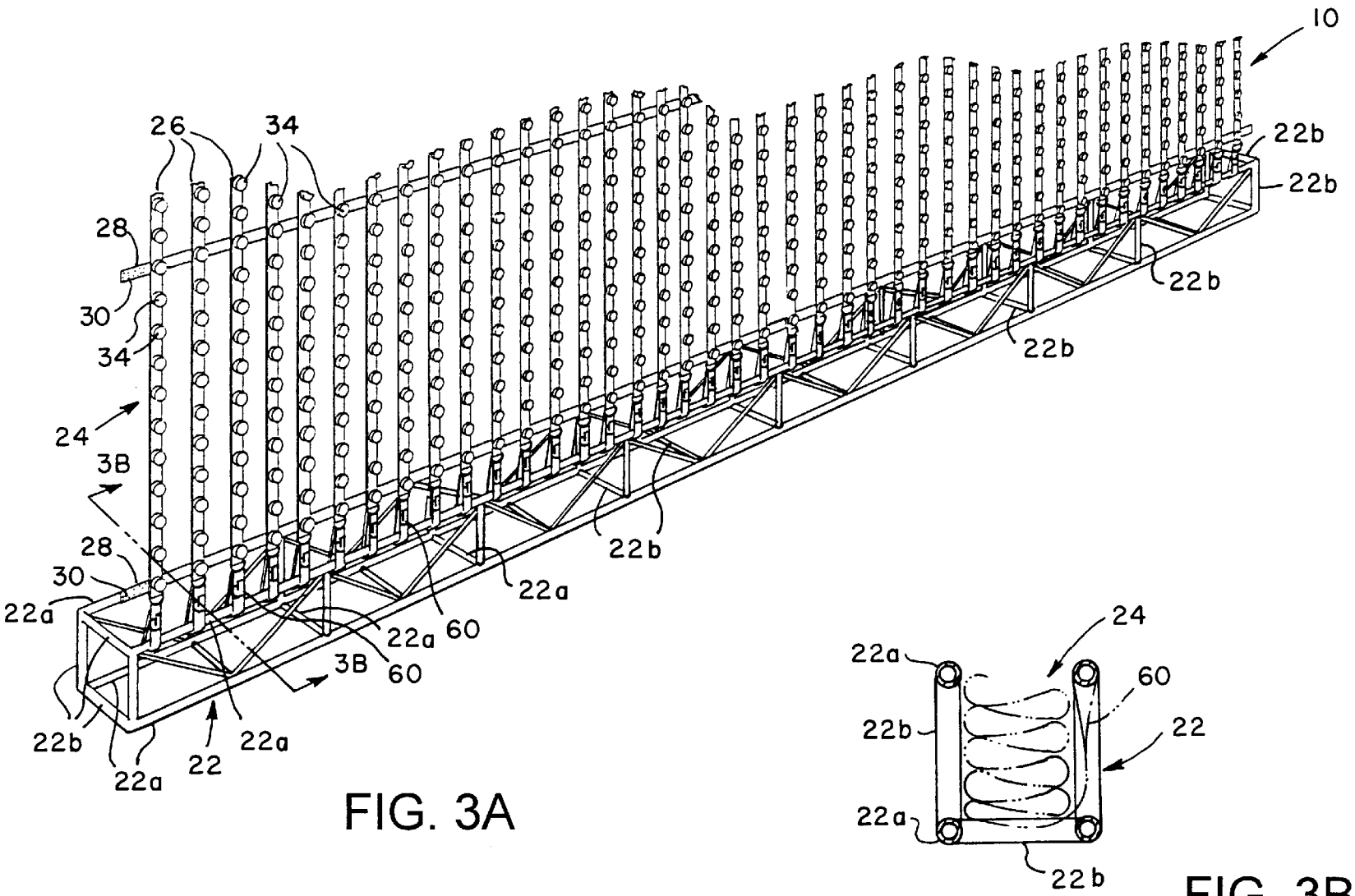
FIG. 3A is a perspective view of a portion of one of the bottom panels of the display system shown in FIG. 1.
FIG. 3B is a detail section view taken along line 3B—3B of FIG. 3A.
Figure 4:
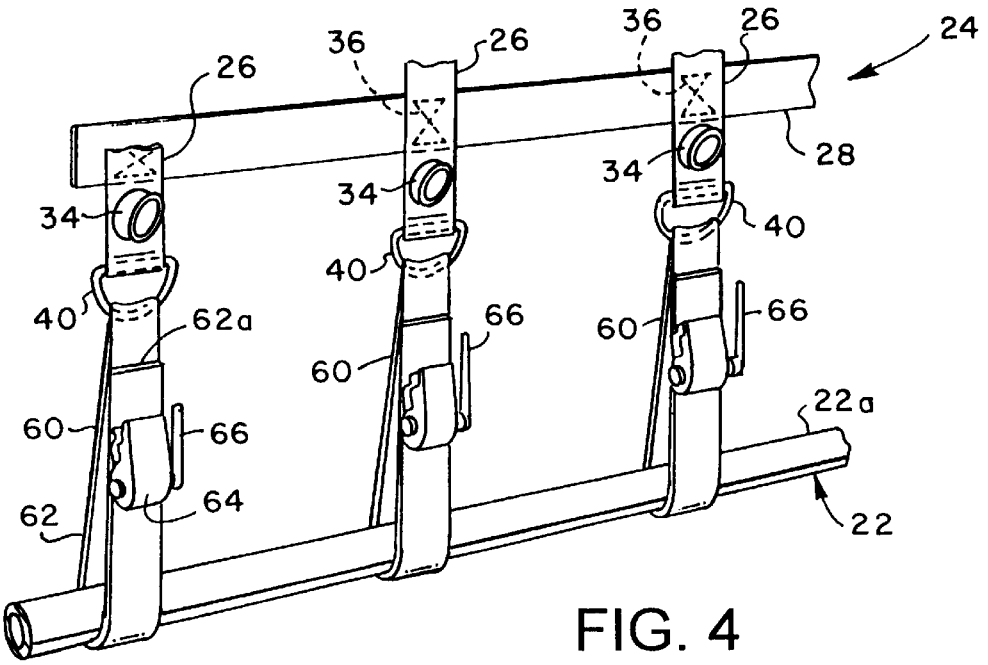
FIG. 4 is a detail perspective view showing a preferred arrangement for connecting the column straps of a panel to a bottom support beam or truss for the display system.
Figure 5:
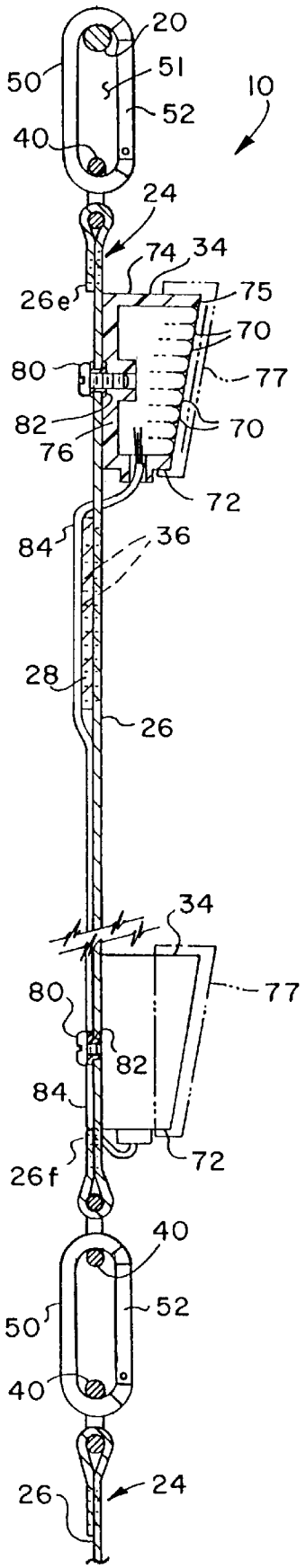
FIG. 5 is a detail section view taken along the line 5—5 of FIG. 1.

Referring now to FIGS. 3A through 5, and FIG. 5 in particular, there is illustrated one preferred arrangement for attaching the respective panels 24 of the display system 10 to each other and to support structure including the cable 20 and beam 22. Each of the support members 26 may be secured to the cable 20 by a suitable connecting member 50 comprising a hook having a throat 51 closeable by a latch 52, for example. A hook 50 may be provided for interconnecting each fastening member or D-ring 40 of each upper panel 24 with the cable 20 or other suitable support structure. A preferred form of the connecting member or hook 50 may be a carabiner of a type commercially available, for example. Carabiners 50 may also be used to releasably connect panels 24 to each other at cooperating aligned ends of adjacent support members 26, as shown by way of example in FIG. 5. As also shown in FIG. 5, each of the straplike support members 26 may be folded back on itself at opposed distal ends 26*e* and 26*f* and stitched to form an eye for retaining the respective connector members 40. As previously mentioned, the support members 26 may be suitably connected to respective ones of the horizontal strap support members 28 at their respective crossing points by conventional stitching 36. Connecting members between each of the panels 24 as well as between the panels and panel support structure may be other forms of connecting elements, such as shackles or any suitable element which is capable of supporting panel weights and any tensioning forces applied thereto.

Referring now to FIGS. 3A and 4, in particular, a preferred arrangement is illustrated for attaching the panels 24 of the lowermost row of panels to the beam members 22. Each of the support members 26 may be secured to the beam 22 at its lower end by a suitable flexible tensioning device 60, for example. Moreover, the truss style beam 22 may be characterized by elongated longitudinal beam members 22*a* which are interconnected by transverse members 22*b*, as illustrated. However, transverse members 22*b* are omitted between the uppermost longitudinal members 22*a* except at opposite ends of a section of support beam 22, as illustrated in FIGS. 3A and 3B. In this way the rectangular boxlike truss beam members 22 may function as storage containers for the panels 24 in that, when the panels are released from the upper support member 20 they may be rolled or folded and, if desired, placed in the confines of the beam members 22, as shown in FIG. 3B, and transported therewith from one site to another. Preferably, each beam member 22 is an elongated section of truss, plural ones of which may be required, placed end-to-end, for the display system 10, as shown in FIG. 1. The box truss type beam members 22 may also receive suitable weights disposed therein when a system 10 is erected in a working position, such as water ballast containers or sandbags, not shown, for maintaining the working position of the members 22 when the system 10 is erected.

Accordingly, the tensioning devices 60 may be connected to the lower connector rings 40 of each of the support members 26 of the lowermost panels 24, as shown in FIGS. 3A and 4. The tensioning devices 60 may comprise flexible strap, ratchet-type tensioning devices, such as are used in various applications for securing articles to a deck or pallet, for example, as well as used in tensioning flexible support members such as guy wires and cables. In particular the tensioning devices 60 each include a flexible strap 62, connected at one end to a ratchet type locking mechanism 64, trained through a connector ring 40, around a truss member 22*a* and then through the mechanism 64 whereby actuation of a manual actuating lever 66 will cause the strap 62 to be tensioned so that a distal end 62*a* is moved toward the ring 40, for example, viewing FIG. 4, to increase tension in the loop formed by the strap. Other means may be provided for tensioning the respective support members 26 when erecting the display system 10.

Figure 6:
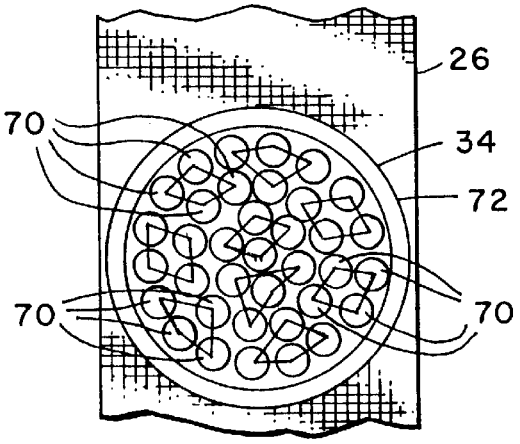
FIG. 6 is a detail front elevation of one of the clustered LED modules.

Referring again to FIGS. 5 and 6, the light sources 34, as previously mentioned, are spaced apart at predetermined distances along the column support members 26 and are suitably secured thereto. In a preferred embodiment of the invention, each of the light sources 34 comprises a cluster of light emitting diodes 70 disposed in a suitable, generally cylindrical housing 72, having a peripheral sidewall 74 and a backwall 76. The light emitting diodes 70 are preferably arranged in clusters of four in somewhat diamond shaped patterns, for example, and each cluster of four diodes may comprise, for example, one blue LED, one green LED, and two red LEDs. Each light source 34 may have plural clusters of LEDs 70 as shown in FIG. 6. Light sources 34 may each comprise seven clusters of four LEDs.

The housing wall 74 may be scarfed at a front edge 75 at a somewhat downward angle, as shown in FIG. 5, to project light in a slight downward direction, depending on the expected placement of the light sources 34 with respect to the viewing audience. Each light source 34 may have its housing 74 constructed in such a way that the LEDs 70 may be disposed to be generally normal to the plane of the scarfed edge 75. The shape of housings 72 and angle of projection of light from the housings may be varied in accordance with their expected working positions on the display 10 relative to the viewing audience. In most large stage applications of display system 10, for example, the audience is below the display and a slight downward tilt of each of the light sources 34 is desirable.

Each of the light sources 34, or selected ones of the light sources, may be provided with a suitable light filter or focusing lens 77, FIG. 5, which may be formed on a suitable cylindrical cap which can be removably secured to respective ones of the housings 72. In this way, the light projected from each light source 34 may be focused in a particular direction for the purposes described above or suitable filtering techniques may be carried out to modify the light intensity and/or color.

Referring further to FIG. 5, each of the housings 72 may be secured to the column support members 26 by a suitable mechanical fastener, such a machine screw 80 projecting through a suitable grommet 82 secured to and projecting through the support member 26 to accommodate the screw so that it may be threadedly engaged with the housing 72. A suitable bundled conductor such as a flat cable insulated conductor 84 extends between each light source 34 and a nearby enclosure 42, see FIG. 7, whereby each panel 24 has an array or matrix of light sources 34 subdivided into groups which are controlled by the circuitry 45 in the respective enclosures 42.

Figure 8:
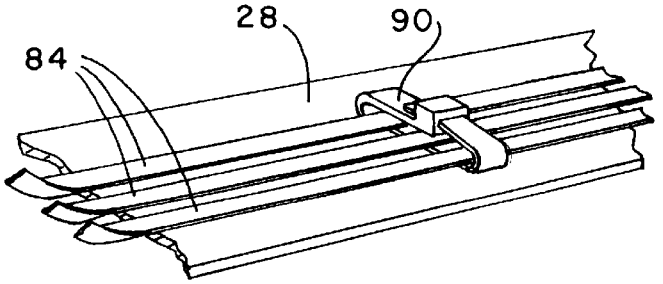
FIG. 8 is a detail perspective view showing a preferred arrangement for routing the conductors for the clustered LED light sources.
Figure 7:
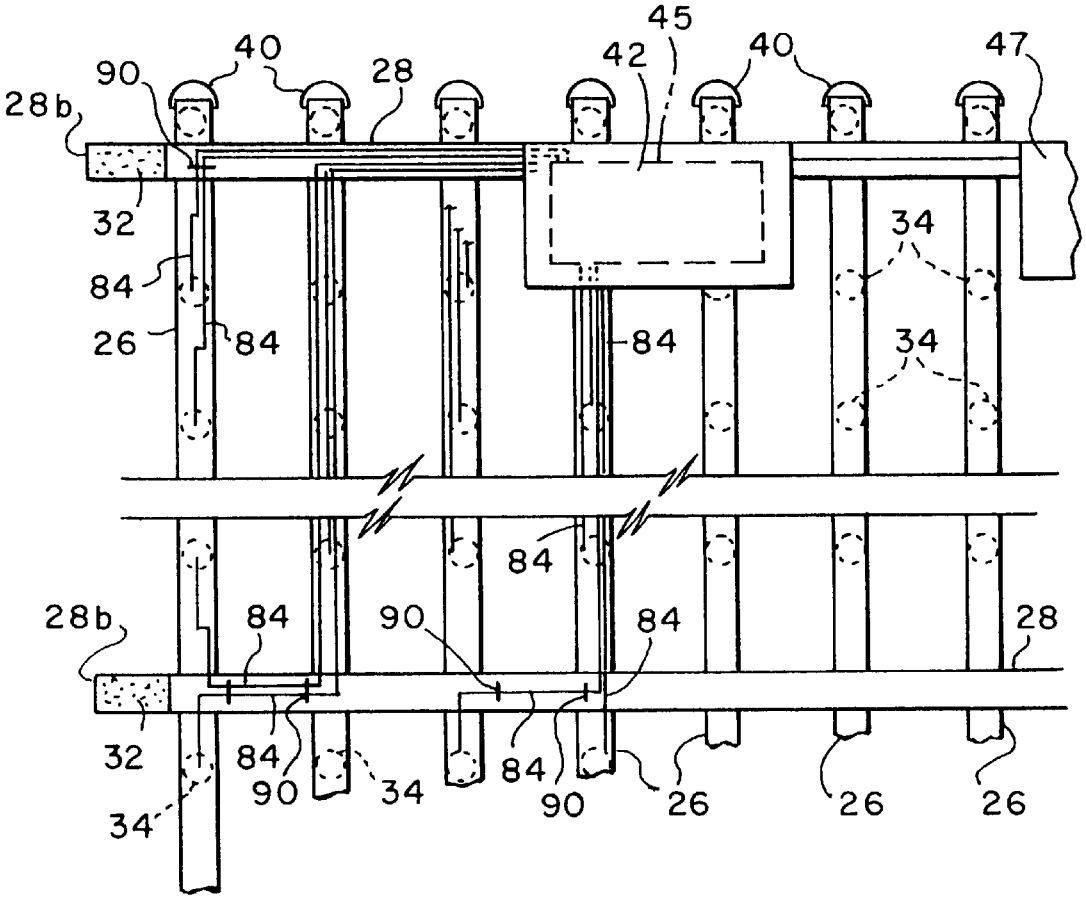
FIG. 7 is a detail rear elevation of a portion of one of the display system panels.

Each conductor 84 leading from a light source 34 to an enclosure 42 may be trained along the backsides of the column members 26 and the horizontal support members 28, for example, as shown in FIGS. 5, 7 and 8. Suitable conductor retention devices 90, such as conventional flexible cable ties, may be suitably secured to the backsides of the support members 26 and 28, as shown by way of example of FIG. 8, for securing the conductors 84 to the respective support members so that they are trained along the support members between the respective light sources 34 and the enclosures 42. The light sources 34 are preferably spaced apart on the support members 26 at positions which do not correspond to the locations where the support members 28 are contiguous with and connected to the support members 26, as indicated in FIGS. 4, 5, and 7. However, as shown in FIGS. 2 and 3 light sources 34 may be placed on the positions where the support members 26 and 28 cross each other. It is preferable, however, to avoid possibly weakening the support members 26 and 28 by forming fastener receiving holes in these members at the locations where they are attached to each other.

The fabrication of the panels 24 is believed to be within the purview of one of ordinary skill in the art based on the foregoing description. The flexible support members 26 and 28, as previously mentioned, are preferably formed of woven nylon or similar polymer material and may be similar to flexible strapping used for various industrial applications. The support members 26 and 28 are suitably connected to each other by conventional stitching at their contiguous points, although other fastening means may be utilized to connect the members to each other to form the web or net like structure for supporting the respective light sources 34.

Insertion of the grommets 82 in the support members 26 at predetermined spaced apart points may be carried out using known techniques and assembling the light sources 34 to the support members may also be carried out in a conventional manner. The light sources 34 may be constructed using known techniques for manufacturing clusters of light emitting diodes. By grouping plural ones of the light emitting diodes or LEDs 70 of selected colors and by controlling their operation in accordance with known techniques, a wide variety of multicolor images may be created on the display system 10.

Although the panels 24 shown and described herein are arranged such that the light sources 34 are disposed on the vertical column support members 26 only, those skilled in the art will also recognize that additional light sources 34 may be placed on the horizontal support members 28 and additional horizontal support members 28 may be provided, each supporting plural spaced apart light sources 34, if desired. The netlike web of panel 24 may also be constructed with the support members 26 and 28 extending diagonally rather than vertically and horizontally and with the light sources 34 arranged on each of the support members, in the manner in which the light sources are supported on the support members 26. Moreover, the web formed by members 26 and 28 may be an integral structure of woven or nonwoven fabric or a sheetlike layer of material.

As previously mentioned, the panels 24 of the display system 10 may be stored for transport in the box truss beam members 22 and upon arrival at a location for erection the panels may be unfolded, secured to each other at their lateral sides by the cooperating hook and loop fasteners strips 28*a* and 28*b* or by other suitable fastening means. Each panel 24 which is vertically disposed above an adjacent panel may then be connected to that panel by the hooks or carabiners 50 and then suitably erected for attachment to the cable 20 using known, conventional rigging techniques. Once the display system 10 has been substantially erected the tensioning devices 60 may be actuated to tension the column support members 26 so that the panels 24 may be substantially co-planar. However, those skilled in the art will recognize that the flexibility of the panels 24 also provides for arranging the display system 10 so that it may curve around the stage area either in a concave or a convex manner, as desired. In fact, one advantage of the display system 10 permits this flexible arrangement of the panels 24. Once the panels 24 have been erected, or prior to erection, suitable control conductors are connected to the respective circuits 45 disposed in the enclosures 42 and to the control system 44 for operation of the display system 10.

Disassembly of the control system 10 may be carried out by substantial reversal of the steps described above. Thanks to the provision of the flexible panels 24 with the web or netlike construction provided by the support members 26 and 28, each panel may be easily folded in one of several selected directions, rolled or otherwise arranged in a substantially compacted manner. In particular, the panels 24 may be merely lowered into the confines of the truss beams 22 whereby these structures may be used as storage containers for the panels for transport purposes.

The display system 10 may weigh less than fifty percent of the weight of prior art image display systems and occupy less than fifty percent of the space, in a derigged storage condition, of such prior art systems. Moreover, the power requirements of the light sources 34 may be a small fraction of that required for prior art display systems.

Although a preferred embodiment of a large scale, portable, image display system has been described in detail herein, those skilled in the art will appreciate that various substitutions and modifications may be made without departing from the scope and spirit of the invention as set forth in the appended claims.

What is claimed is:

1. A large scale, portable, image display system comprising:

a plurality of flexible panels interconnected with each other to form an image display area, each of said panels comprising a web structure formed of plural spaced apart, flexible strap members extending vertically from one edge of said panel to the other and plural, spaced apart, generally horizontally extending flexible strap members connected to said vertically extending strap members;

a plurality of light emitting diode light sources mounted on selected ones of said strap members at predetermined spaced apart positions thereon to form a matrix of light sources for projecting an image from said display system;

means for connecting said panels to each other; and means for connecting said panels to support means for said display system for supporting said display system in a working position of said light sources, respectively.

2. A portable image display system comprising:

a plurality of flexible panels interconnected with each other to form an image display area, each of said panels comprising a generally rectangular web formed of flexible, foldable material and providing support means for a plurality of light emitting diode light sources mounted on said panel at predetermined spaced apart positions thereon to form a matrix of light sources for projecting an image from said display system;

fastener means disposed at opposed vertical edges of said panels for connecting said panels to each other;

connector means disposed at opposed horizontal edges of said panels for connecting said panels to each other and to a generally horizontally extending support member; and tensioning means connected to at least one horizontal edge of said panels, respectively, for connecting said panels to a support structure for securing said panels in a generally tensioned planar array for projecting images from said display area.

3. The display system set forth in claim 2 wherein:

said support means for said panels comprise at least one elongated beam member operable to be disposed on a surface below said display system and connected to said tensioning means, respectively, for tensioning said panels of said display system, said beam member defining an enclosure for receiving said panels in a folded condition thereof, respectively, for storage and transport of said display system.

4. An image display system comprising:

at least one panel comprising a web of flexible support members including a first set of flexible support members extending in one direction and a second set of flexible support members extending in another direction, said first and second sets of support members are interconnected with each other at respective positions wherein respective ones of said support members of said first set are contiguous with respective ones of said support members of said second set; and a plurality of light sources supported on said support members of at least one set at predetermined spaced apart positions thereon, said light sources being adapted to be connected to a control circuit for energizing said light sources to generate a visual image by said display system.

5. The display system set forth in claim 4 wherein:

the support members of said first set are arranged in substantially vertical columns and the support members of said second set extend substantially horizontally in spaced apart rows and interconnect the support members of said first set.

6. The display system set forth in claim 5 wherein:

said light sources each include a housing mounted on the support members of the first set at spaced apart points therealong to form a matrix of light sources of plural rows and columns of said light sources, respectively.

7. The display system set forth in claim 6 wherein:

selected ones of said light sources include lens means mountable on said housings of said selected light sources for at least one of focusing and filtering light emitted by said light sources, respectively.

8. A The display system set forth in claim 6 including:

conductor means extending between each of said light sources and a control circuit mounted on said panel, said conductor means being trained along said support members between said light sources and said control circuit.

9. The display system set forth in claim 8 including:

at least one power supply unit supported on said panel and operably connected to said control circuit for supplying electrical power to said control circuit and said light sources, respectively.

10. The display system set forth in claim 8 including:

spaced apart retaining means mounted on said support members for retaining said conductor means in predetermined positions on said such support members between said light sources and said control circuit.

11. An image display system comprising:

plural panels connected to each other, each of said panels comprising a web of flexible support members including a first set of flexible support members extending in one direction and a second set of flexible support members extending in another direction, each of said panels including a plurality of light sources supported on said support members of at least one set at predetermined spaced apart positions thereon, said light sources being adapted to be connected to a control circuit for energizing said light sources to generate a visual image by said display system, and each of said panels including connector means for connecting one panel to an adjacent panel to form a substantially planar, large scale image display.

12. The display system set forth in claim 11 wherein:

selected ones of said support members are connected to tensioning means for securing at least one edge of said display system to support means therefor.

13. An image display system comprising:

at least one panel comprising a web of flexible support members including a first set of flexible support members extending in one direction and a second set of flexible support members extending in another direction;

a plurality of light sources supported on said support members of at least one set at predetermined spaced apart positions thereon, said light sources being adapted to be connected to a control circuit for energizing said light sources to generate a visual image by said display system;

support means for at least one generally horizontal edge of said panel comprising an elongated beam; and tensioning means connected to said beam and to respective ones of said support members of said panel for tensioning said support members when said display system is erected in a working position.

14. The display system set forth in claim 13 wherein:

said beam comprises means providing an enclosure for storing said at least one panel in a folded condition for transport or storage.

15. An image display system comprising:

at least one panel comprising a web of flexible support members including a first set of flexible, elongated straps extending in one direction and a second set of flexible, elongated straps extending in another direction, said straps of said first set intersecting said straps of said second set, respectively, and said straps of said first and second sets being secured to each other at their respective points of intersection to form said web; and a plurality of light sources supported on said straps of at least one set at predetermined spaced apart positions thereon said light sources being adapted to be connected to a control circuit for energizing said light sources selectively to generate a visual image by said display system.

16. The display system set forth in claim 15 wherein:

said light sources comprise light emitting diodes, respectively.

17. The display system set forth in claim 16 wherein:

each of said light sources comprises plural ones of said light emitting diodes, respective ones of said light emitting diodes being operable to emit light of different colors.

18. The display system set forth in claim 16 wherein:

each of said light sources comprises a housing and means for connecting said housing to one of said support members at a predetermined position on said one support member, and plural light emitting diodes are mounted in said housing and positioned to project light in a predetermined direction from said housing.

* * * * *